US008608510B2

(12) United States Patent
Buck et al.

(10) Patent No.: US 8,608,510 B2
(45) Date of Patent: Dec. 17, 2013

(54) DUAL IMPEDANCE ELECTRICAL CONNECTOR

(75) Inventors: Jonathan E. Buck, Hershey, PA (US); Stephen B. Smith, Mechanicsburg, PA (US)

(73) Assignee: FCI Americas Technology LLC, Carson City, NV (US)

( * ) Notice: Subject to any disclaimer, the term of this patent is extended or adjusted under 35 U.S.C. 154(b) by 201 days.

(21) Appl. No.: 12/832,489

(22) Filed: Jul. 8, 2010

(65) Prior Publication Data

US 2011/0021083 A1 Jan. 27, 2011

Related U.S. Application Data

(60) Provisional application No. 61/228,269, filed on Jul. 24, 2009.

(51) Int. Cl.
*H01R 13/648* (2006.01)

(52) U.S. Cl.
USPC ..... 439/607.07; 439/108

(58) Field of Classification Search
USPC ..... 439/79, 108, 607.05–607.07, 607.1, 439/607.39, 660
See application file for complete search history.

(56) References Cited

U.S. PATENT DOCUMENTS

| | | | |
|---|---|---|---|
| 3,286,220 | A | 11/1966 | Marley et al. |
| 3,538,486 | A | 11/1970 | Shlesinger, Jr. |
| 3,669,054 | A | 6/1972 | Desso et al. |
| 3,748,633 | A | 7/1973 | Lundergan |
| 4,076,362 | A | 2/1978 | Ichimura |
| 4,159,861 | A | 7/1979 | Anhalt |
| 4,260,212 | A | 4/1981 | Ritchie et al. |
| 4,288,139 | A | 9/1981 | Cobaugh et al. |
| 4,383,724 | A | 5/1983 | Verhoeven |
| 4,402,563 | A | 9/1983 | Sinclair |
| 4,560,222 | A | 12/1985 | Dambach |
| 4,717,360 | A | 1/1988 | Czaja |
| 4,776,803 | A | 10/1988 | Pretchel et al. |
| 4,815,987 | A | 3/1989 | Kawano et al. |
| 4,867,713 | A | 9/1989 | Ozu et al. |

(Continued)

FOREIGN PATENT DOCUMENTS

| | | |
|---|---|---|
| EP | 0273683 | 7/1988 |
| EP | 0891016 | 10/2002 |

(Continued)

OTHER PUBLICATIONS

U.S. Appl. No. 61/141,990, filed Dec. 31, 2008, Swain et al.

(Continued)

*Primary Examiner* — Thanh Tam Le
(74) *Attorney, Agent, or Firm* — Woodcock Washburn LLP

(57) ABSTRACT

An electrical power connector comprises a housing having a mounting interface and a mating interface. The mating interface defines a plurality of receptacles spaced apart in more than one direction. A plurality of electrical contacts is supported by the housing. These electrical contacts define respective mounting ends that are configured to electrically connect with an electrical component at the mounting interface, and opposed mating ends. At least one of the electrical contacts defines a common contact beam disposed within at least a select one of the receptacles. This common contact beam is configured to be electrically connected to a pair of adjacent electrical contacts of a mated electrical connector.

20 Claims, 3 Drawing Sheets

(56) References Cited

U.S. PATENT DOCUMENTS 4,907,990 A 3/1990 Bertho et al.
4,913,664 A 4/1990 Dixon et al.
4,973,271 A 11/1990 Ishizuka et al.
5,066,236 A 11/1991 Broeksteeg
5,077,893 A 1/1992 Mosquera et al.
5,094,623 A 3/1992 Scharf et al.
5,163,849 A 11/1992 Fogg et al.
5,167,528 A 12/1992 Nishiyama et al.
5,174,770 A 12/1992 Sasaki et al.
5,238,414 A 8/1993 Yaegashi et al.
5,254,012 A 10/1993 Wang
5,274,918 A 1/1994 Reed
5,277,624 A 1/1994 Champion et al.
5,286,212 A 2/1994 Broeksteeg
5,302,135 A 4/1994 Lee
5,342,211 A 8/1994 Broeksteeg
5,356,300 A 10/1994 Costello et al.
5,356,301 A 10/1994 Champion et al.
5,357,050 A 10/1994 Baran et al.
5,431,578 A 7/1995 Wayne
5,475,922 A 12/1995 Tamura et al.
5,558,542 A 9/1996 O'Sullivan et al.
5,586,914 A 12/1996 Foster, Jr. et al.
5,590,463 A 1/1997 Feldman et al.
5,609,502 A 3/1997 Thumma
5,713,746 A 2/1998 Olson et al.
5,730,609 A 3/1998 Harwath
5,741,144 A 4/1998 Elco et al.
5,741,161 A 4/1998 Cahaly et al.
5,795,191 A 8/1998 Preputnick et al.
5,817,973 A 10/1998 Elco
5,853,797 A 12/1998 Fuchs et al.
5,908,333 A 6/1999 Perino et al.
5,961,355 A 10/1999 Morlion et al.
5,967,844 A 10/1999 Doutrich et al.
5,971,817 A 10/1999 Longueville
5,980,321 A 11/1999 Cohen et al.
5,993,259 A 11/1999 Stokoe et al.
6,050,862 A 4/2000 Ishii
6,068,520 A 5/2000 Winings et al.
6,116,926 A 9/2000 Ortega et al.
6,116,965 A 9/2000 Arnett et al.
6,123,554 A 9/2000 Ortega et al.
6,125,535 A 10/2000 Chiou et al.
6,129,592 A 10/2000 Mickievicz et al.
6,139,336 A 10/2000 Olson
6,146,157 A 11/2000 Lenoir et al.
6,146,203 A 11/2000 Elco et al.
6,171,115 B1 1/2001 Mickievicz et al.
6,171,149 B1 1/2001 van Zanten
6,190,213 B1 2/2001 Reichart et al.
6,212,755 B1 4/2001 Shimada et al.
6,219,913 B1 4/2001 Uchiyama
6,220,896 B1 4/2001 Bertoncini et al.
6,227,882 B1 5/2001 Ortega et al.
6,267,604 B1 7/2001 Mickievicz et al.
6,269,539 B1 8/2001 Takahashi et al.
6,280,209 B1 8/2001 Bassler et al.
6,293,827 B1 9/2001 Stokoe
6,309,246 B1 10/2001 Keaton et al.
6,319,075 B1 11/2001 Clark et al.
6,322,379 B1 11/2001 Ortega et al.
6,322,393 B1 11/2001 Doutrich et al.
6,328,602 B1 12/2001 Yamasaki et al.
6,343,955 B2 2/2002 Billman et al.
6,347,952 B1 2/2002 Hasegawa et al.
6,350,134 B1 2/2002 Fogg et al.
6,354,877 B1 3/2002 Shuey et al.
6,358,061 B1 3/2002 Regnier
6,361,366 B1 3/2002 Shuey et al.
6,363,607 B1 4/2002 Chen et al.
6,364,710 B1 4/2002 Billman et al.
6,371,773 B1 4/2002 Crofoot et al.
6,375,478 B1 4/2002 Kikuchi
6,379,188 B1 4/2002 Cohen et al.
6,386,914 B1 5/2002 Collins et al.
6,409,543 B1 6/2002 Astbury, Jr. et al.
6,431,914 B1 8/2002 Billman
6,435,914 B1 8/2002 Billman
6,461,202 B2 10/2002 Kline
6,471,548 B2 10/2002 Bertoncini et al.
6,482,038 B2 11/2002 Olson
6,485,330 B1 11/2002 Doutrich
6,494,734 B1 12/2002 Shuey
6,506,081 B2 1/2003 Blanchfield et al.
6,520,803 B1 2/2003 Dunn
6,527,587 B1 3/2003 Ortega et al.
6,537,087 B2 3/2003 McNamara et al.
6,537,111 B2 3/2003 Brammer et al.
6,540,559 B1 4/2003 Kemmick et al.
6,547,066 B2 4/2003 Koch
6,547,606 B1 4/2003 Johnston et al.
6,554,647 B1 4/2003 Cohen et al.
6,572,410 B1 6/2003 Volstorf et al.
6,652,318 B1 11/2003 Winings et al.
6,692,272 B2 2/2004 Lemke et al.
6,695,627 B2 2/2004 Ortega et al.
6,762,067 B1 7/2004 Quinones et al.
6,764,341 B2 7/2004 Lappoehn
6,776,649 B2 8/2004 Pape et al.
6,805,278 B1 10/2004 Olson et al.
6,808,399 B2 10/2004 Rothermel et al.
6,824,391 B2 11/2004 Mickievicz et al.
6,843,686 B2 1/2005 Ohnishi et al.
6,848,944 B2 2/2005 Evans
6,851,974 B2 2/2005 Doutrich
6,852,567 B1 2/2005 Lee et al.
6,863,543 B2 3/2005 Lang et al.
6,869,292 B2 3/2005 Johnescu et al.
6,890,214 B2 5/2005 Brown et al.
6,899,566 B2 5/2005 Kline et al.
6,913,490 B2 7/2005 Whiteman et al.
6,932,649 B1 8/2005 Rothermel et al.
6,945,796 B2 9/2005 Bassler et al.
6,953,351 B2 10/2005 Fromm et al.
6,969,280 B2 11/2005 Chien et al.
6,976,886 B2 12/2005 Winings et al.
6,981,883 B2 1/2006 Raistrick et al.
6,988,902 B2 1/2006 Winings et al.
6,994,569 B2 2/2006 Minich et al.
7,097,506 B2 8/2006 Nakada
7,114,964 B2 10/2006 Winings et al.
7,118,391 B2 10/2006 Minich et al.
7,131,870 B2 * 11/2006 Whiteman et al. ..... 439/607.06
7,180,011 B1 2/2007 Hall et al.
7,182,643 B2 2/2007 Winings et al.
7,229,318 B2 6/2007 Winings et al.
7,270,574 B1 9/2007 Ngo
7,331,800 B2 2/2008 Winings et al.
7,390,218 B2 * 6/2008 Smith et al. ..... 439/607.1
7,442,054 B2 * 10/2008 Lemke et al. ..... 439/79
7,462,924 B2 * 12/2008 Shuey ..... 439/607.07
7,467,955 B2 12/2008 Raistrick et al.
7,524,209 B2 * 4/2009 Hull et al. ..... 439/607.01
7,544,096 B2 * 6/2009 Cohen et al. ..... 439/607.05
7,549,897 B2 * 6/2009 Fedder et al. ..... 439/751
7,713,088 B2 * 5/2010 Sercu et al. ..... 439/607.1
7,914,305 B2 * 3/2011 Amleshi et al. ..... 439/101
2001/0005654 A1 6/2001 Cohen et al.
2002/0098727 A1 7/2002 McNamara et al.
2002/0106930 A1 8/2002 Pape et al.
2003/0092291 A1 5/2003 Lemke et al.
2003/0143894 A1 7/2003 Kline et al.
2003/0171010 A1 9/2003 Winings et al.
2003/0180011 A1 9/2003 Aronson
2003/0203665 A1 * 10/2003 Ohnishi et al. ..... 439/79
2003/0220018 A1 11/2003 Winings et al.
2003/0220021 A1 11/2003 Whiteman et al.
2005/0009402 A1 1/2005 Chien et al.
2005/0020109 A1 1/2005 Raistrick et al.
2005/0118869 A1 6/2005 Evans
2005/0164555 A1 7/2005 Winings et al.
2005/0170700 A1 8/2005 Shuey et al.
2005/0196987 A1 9/2005 Shuey et al.

(56) References Cited

U.S. PATENT DOCUMENTS

| | | | | |
|---|---|---|---|---|
| 2005/0277221 | A1 | 12/2005 | Mongold et al. | |
| 2005/0287849 | A1 | 12/2005 | Winings et al. | |
| 2005/0287850 | A1 | 12/2005 | Minich et al. | |
| 2006/0014433 | A1 | 1/2006 | Consoli et al. | |
| 2006/0019517 | A1 | 1/2006 | Raistrick et al. | |
| 2006/0035530 | A1 | 2/2006 | Shuey et al. | |
| 2006/0046526 | A1 | 3/2006 | Minich | |
| 2006/0063404 | A1 | 3/2006 | Minich et al. | |
| 2006/0068641 | A1 | 3/2006 | Hull et al. | |
| 2006/0192274 | A1 | 8/2006 | Lee et al. | |
| 2006/0234531 | A1 | 10/2006 | Winings et al. | |
| 2006/0234532 | A1 | 10/2006 | Winings et al. | |
| 2006/0246756 | A1 | 11/2006 | Winings et al. | |
| 2007/0059952 | A1 | 3/2007 | Raistrick et al. | |
| 2007/0207674 | A1 * | 9/2007 | Minich | 439/608 |
| 2008/0045062 | A1 | 2/2008 | Jang et al. | |
| 2008/0214029 | A1 | 9/2008 | Lemke et al. | |
| 2008/0248693 | A1 | 10/2008 | Winings et al. | |
| 2009/0017682 | A1 * | 1/2009 | Amleshi et al. | 439/608 |

FOREIGN PATENT DOCUMENTS

| | | |
|---|---|---|
| EP | 1148587 | 4/2005 |
| JP | 06236788 | 8/1994 |
| JP | 07114958 | 5/1995 |
| JP | 11185886 | 7/1999 |
| JP | 2000/003743 | 1/2000 |
| JP | 2000/003744 | 1/2000 |
| JP | 2000/003745 | 1/2000 |
| JP | 2000/003746 | 1/2000 |
| WO | WO 90/16093 | 12/1990 |
| WO | WO 01/29931 | 4/2001 |
| WO | WO 01/39332 | 5/2001 |
| WO | WO 02/101882 | 12/2002 |
| WO | WO 03/043138 | 5/2003 |
| WO | WO 2005/018051 | 2/2005 |
| WO | WO 2006/031296 | 3/2006 |

OTHER PUBLICATIONS

International Patent Application No. PCT/US2010/042430: International Search Report dated Jan. 26, 2011, 11 pages.
"4.0 UHD Connector: Differential Signal Crosstalk, Reflections", 1998, 8-9.
"AMP Z-Dok and Z-Dok + Connectors", Application Specification No. 114-13068, Aug. 30, 2005, Rev A, Tyco Electronics, 17 pages.
"AMP Z-Pack 2mm HM Interconnection System", AMP Incorporated, 1992 and 1994, 6 pages.
"AMP Z-Pack 2mm HM Connector, 2mm Centerline, Eight-Row, Right-Angle Applications, Electrical Performance Report", EPR 889065, AMP Incorporated, Sep. 1998, 59 pages.
"AMP Z-Pack HM-Zd Performance at Gigabit Speeds", Report #20GC014, Rev. B., Tyco Electronics, May 4, 2001, 32 pages.
"B.? Bandwidth and Rise Time Budgets", Module 1-8, Fiber Optic Telecommunications (E-XVI-2a), http://cord.org/step_online/st1-8/st18exvi2a.htm, 2006, 1-3.
"Backplane Products Overview Page", http://www.molex.com/cgi-bin/bv/molex/super_family/super_family.jsp?BV_SessionID=@, Molex, 2005-2006, 4 pages.
"Champ Z-Dok Connector System", Tyco Electronics, Catalog No. 1309281, Jan. 2002, 3 pages.
"FCI's Airmax VS Connector System Honored at DesignCon 2005", http://www.heilind.com/products/fci/airmax-vs-design.asp, Heilind Electronics, Inc., 2005, 1 page.
Framatome Connector Specification, May 10, 1999, 1 page.
Fusi et al., "Differential Signal Transmission through Backplanes and Connectors", Electronic Packaging and Production, Mar. 1996, 27-31.
"Gig-Array High Speed Mezzanine Connectors 15-40 mm Board to Board", FCI Corporation, Jun. 5, 2006, 1 page.
Goel et al., "AMP Z-Pack Interconnect System", AMP Incorporated, 1990, 9 pages.
"HDM, HDM Plus Connectors", http://www.teradyne.com/prods/tcs/products/connectors/backplane/hdm/index.html, Amphenol TCS, 2006, 1 page.
"HDM/HDM Plus, 2mm Backplane Interconnection System", Teradyne Connection Systems, 1993, 22 pages.
"HDM Separable Interface Detail", Molex, Feb. 17, 1993, 3 pages.
"HDM Stacker Signal Integrity", http://www.teradyne.com/prods/tcs/products/connectors/mezzanine/hdm_stacker/signintegr, Amphenol TCS, (ATCS), 2006, 1-3.
"Honda High-Speed Backplane Connector NSP Series", Honda Connectors, Feb. 7, 2003, 25 pages.
Hult, "FCI's Problem Solving Approach Changes Market, The FCI Electronics AirMax VS", http://www.connecotrsupplier.com/tech_updates_FCI-Airmax_archive.htm, ConnectorSupplier.com, 2006, 1-4.
"Lucent Technologies' Bell Labs and FCI Demonstrate 25gb/S Data Transmission Over Electrical Backplane Connectors", http://www.lucent.com/press/0205/050201.bla.html, Feb. 1, 2005, 1-4.
"Metral Speed and Density Extensions", FCI, Jun. 3, 1999, 1-25.
"Metral 2mm High-Speed Connectors, 1000, 2000, 3000 Series, Electrical Performance Data for Differential Applications", FCI Framatome Group, 2 pages.
"Mezzanine High Speed High-Density Connectors, Gig-Array and Meg-Array Electrical Performance Data", FCI Corporation, 10 pages.
Millipacs Connector Type S Specification, Dec. 14, 2004, 1 page.
Nadolny et al., "Optimizing Connector Selection for Gigabit Signal Speeds", http://www.ecnmag.com/articie/CA45245, ECN, Sep. 1, 2000, 6 pages.
"NSP Series, Backplane High-Speed Data Transmission Cable Connectors", http://www.honda-connectors.co.jp, Honda Connectors, 2006, 6 pages, English Translation attached.
"PCB-Mounted Receptabie Assemblies, 2.00 mm (0.079in) Centerlines, Right-Angle Soldier-to-Board Signal Receptable", Metral, Berg Electronics, 10-6-10-7.
"VHDM Connector", http://www.teradyne.com/prods/tcs/products/connectors/backplane/vhdm/index.html, Amphenol TCS (ATCS), 2006, 2 pages.
"VHDM Daughterboard Connectors Feature Press-Fit Terminations and a Non-Stubbing Separable Interface", Teradyne, Inc. Connections Sys Div, Oct. 8, 1997, 46 pages.
"VHDM High-Speed Differential (VHDM HSD)", http://www.teradyne.com/prods/bps/vhdm/hsd.html, Jan. 24, 2000, 6 pages.
"VHDM L-Series Connector", http://www.teradyne.com/prods/tcs/products/connectors/backplane/vhdmm_1-series/index.html, Amphenol TCS (ATCS), 2006, 4 pages.
"Z-Dok + Connector", http://zdok.tyco.electronics.com, Tyco Electronics, May 23, 2003, 1-15.

* cited by examiner

DUAL IMPEDANCE ELECTRICAL CONNECTOR

CROSS-REFERENCE TO RELATED APPLICATIONS

This application claims the benefit of provisional U.S. Patent Application Ser. No. 61/228,269 filed on Jul. 24, 2009, the disclosure of which is hereby incorporated by reference as if set forth in its entirety herein.

BACKGROUND

An electrical connector may include a plurality of leadframe assemblies disposed adjacent to one another in a connector housing. The connector may have a mounting interface that defines a first plane and mating interface that defines a second plane. Where the plane of the mating interface is orthogonal to the plane of the mounting interface, the connector may be referred to as a right-angle connector. Where the plane of the mating interface is parallel to the plane of the mounting interface, the connector may be referred to as a mezzanine connector.

Each such leadframe assembly may include a leadframe housing, which may be made of a dielectric material, such as a plastic, for example. A plurality of electrical contacts may extend through the leadframe housing. The contacts may be made of an electrically conductive material. The contacts may be stamped from a sheet of electrically-conductive material to form a leadframe. The leadframe housing may be overmolded onto the leadframe. Such a leadframe assembly may be referred to as an insert-molded leadframe assembly (IMLA).

Each contact may have a mating end, which may be a receptacle, blade, or other desirable mating end. Each contact may have a respective mounting end, which may be an eye-of-the-needle type mounting end, or a pin, ball, or other desirable mounting end, or terminate in a fusible mounting element, such as a solder ball, for example.

The mating ends of the contacts within a leadframe assembly may form a linear array extending along a first direction. The mating ends of the contacts may be arranged along a common centerline that extends along the first direction. The mounting ends of the contacts may form a linear array extending along a second direction, which may be parallel to the first direction (in the case of a mezzanine connector) or perpendicular to the first direction (in the case of a right angle connector). The mounting ends of the contacts may align along a common centerline that extends along the second direction.

Differential signal pairs of electrical contacts may be arranged edge to edge (i.e., edge-coupled) or broadside-to-broadside (i.e., broadside-coupled). Contacts may be arranged in a signal-signal-ground arrangement along either columns or rows.

A differential signal pair has a differential impedance between the positive conductor and negative conductor of the differential signal pair. Differential impedance is defined as the impedance existing between two signal conductors of the same differential signal pair, at a particular point along the length of the differential signal pair. It is desirable to control the differential impedance to match the impedance of the electrical device(s) to which the connector is connected. Matching the differential impedance to the impedance of electrical device minimizes signal reflection and/or system resonance that can limit overall system bandwidth. Furthermore, it is desirable to control the differential impedance such that it is substantially constant along the length of the differential signal pair, i.e., such that each differential signal pair has a substantially consistent differential impedance profile.

The differential impedance profile can be controlled by the positioning of the signal and ground contacts. Specifically, differential impedance may be determined by the proximity of the signal contact to an adjacent ground contact, and by the gap between edges of signal contacts within a differential signal pair.

To maintain acceptable differential impedance control for high bandwidth systems, it is desirable to control the gap between contacts to within a few thousandths of an inch. Gap variations beyond a few thousandths of an inch may cause an unacceptable variation in the impedance profile; however, the acceptable variation is dependent on the speed desired, the error rate acceptable, and other design factors.

In addition to conductor placement, differential impedance may be affected by the dielectric properties of material proximate to the conductors. Generally, it is desirable to have materials having very low dielectric constants adjacent and in contact with as much of the conductors as possible. The use of air rather than plastic as a dielectric provides a number of benefits.

Additional background may be found in U.S. Pat. No. 7,270,574, U.S. Pat. No. 6,994,569, and U.S. Patent Application Ser. No. 61/141,990, filed Dec. 31, 2008, the disclosure of each of which is incorporated herein by reference.

SUMMARY

As disclosed herein, an electrical connector may include a plurality of electrical contacts arranged into rows and columns. An edge-coupled differential signal pair of the contacts may provide a first pre-established differential impedance, while a broadside-coupled differential signal pair of the contacts may provide a second pre-established differential impedance, which may be different from the first pre-established differential impedance. Accordingly, a single connector may be designed to provide an 85±10Ω differential impedance when wired for edge-coupled pairs and a 100±10Ω differential impedance when wired for broadside-coupled pairs.

As used herein, the term "pre-established differential impedance" refers to a differential impedance that is designed into the connector, as distinct from a differential impedance that exists merely as a fallout of the design. In other words, the connector is designed to provide two specific differential impedances that are known a priori, as distinct from prior art connectors that are designed to provide one pre-established differential impedance, while the other is not designed into the connector, but rather merely a fallout of design.

DETAILED DESCRIPTION

Figure 1:
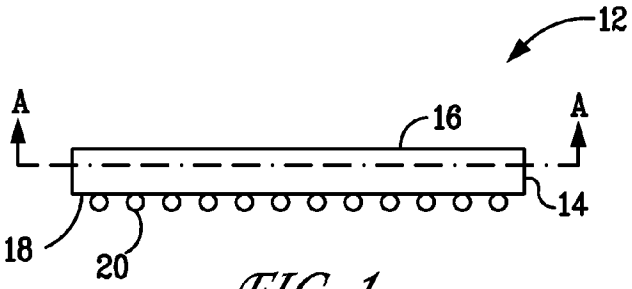
FIG. 1 depicts an example mezzanine-style electrical connector.

FIG. 1 depicts an example mezzanine-style electrical connector 12. Such a connector may include a connector housing 14, which may be made of a dielectric material, such as a plastic. The connector 12 may include a plurality of electrical contacts (shown in FIGS. 2A and 2B). Each contact may have a respective mating end 16 and a respective mounting end 18. The mounting ends may terminate in fusible elements, such as solder balls 20. Such a connector 12 may be referred to as a ball grid array connector. The arrangement of the mounting ends 18 may define the connector's "footprint."

Figure 2B:
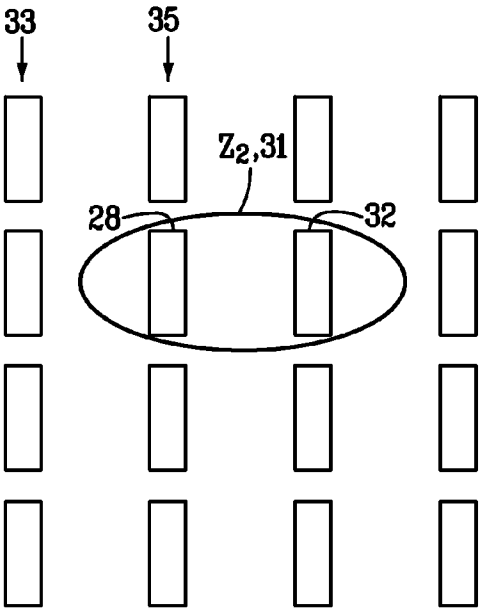
FIGS. 2A and 2B depict partial sectional views of the connector in FIG. 1 along plane A and shows different differential signal pair designations within an example contact arrangement.
Figure 2A:
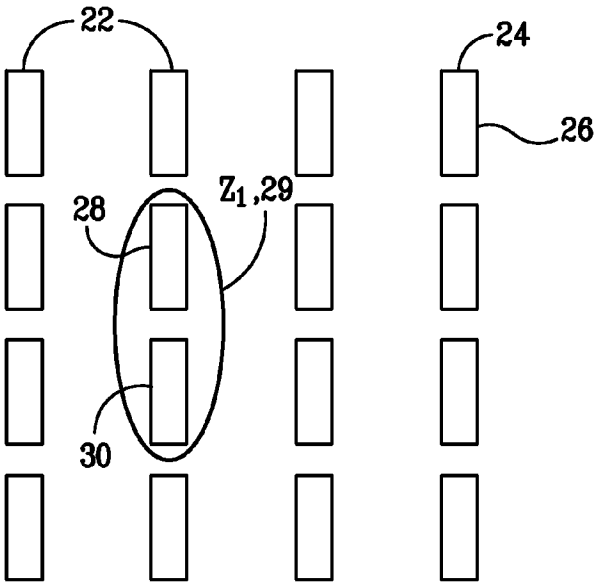

FIGS. 2A and 2B show arrangements of the contacts of connector 12 according to partial sectional views along plane A of connector 12 as indicated by FIG. 1. FIGS. 2A and 2B also depict different differential signal pair designations 29, 31 within an example contact arrangement. As shown, each of the contacts 22 may have a respective edge 24 and a respective broadside 26, where the broadside of the contact is wider than the edge. First and second contacts 28, 30 are positioned edge-to-edge along a first direction as highlighted in FIG. 2A by signal pair designation 29. The first contact 28 may be positioned broadside-to-broadside with a third contact 32 along a second direction that is perpendicular to the first direction as highlighted in FIG. 2B by signal pair designation 31.

The first and second contacts 28, 30 may define an edge-coupled differential signal pair 29 having a first pre-established differential impedance $Z_1$. The first and third contacts 28, 32 may define a broadside-coupled differential signal pair 31 having a second pre-established differential impedance $Z_2$ that is different from the first pre-established differential impedance $Z_1$. For example, the first pre-established differential impedance $Z_1$ may be 85 ohms, while the second pre-established differential impedance is 100 ohms $Z_2$.

As used herein, a stated differential impedance value refers to the stated value plus or minus 10% tolerance for that value. For example, the stated value "100Ω" refers to 100 Ω±10%, or 90-110Ω. Similarly, the stated value "85Ω" refers to 85 Ω±10%, or 76.5-93.5 Ω.

Figure 3:
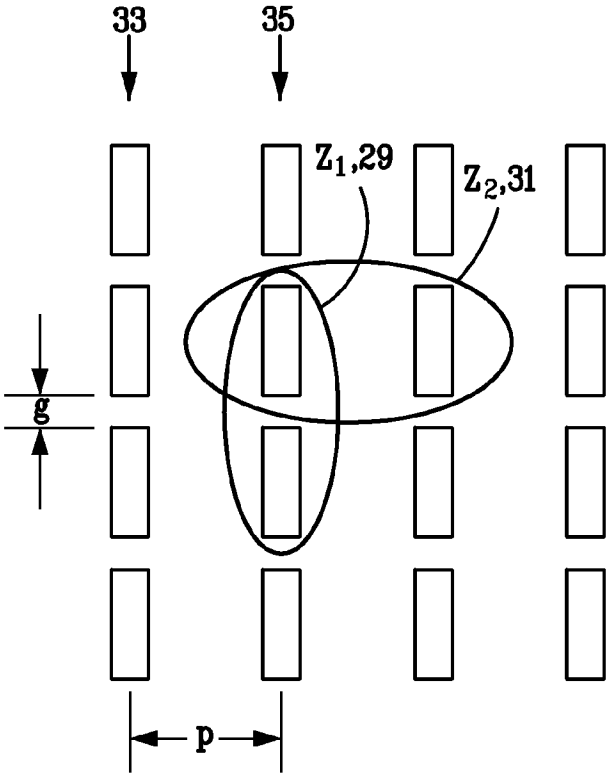
FIG. 3 depicts certain structural aspects of a contact arrangement that may be varied to affect differential impedance.

FIG. 3 depicts certain structural aspects of a contact arrangement that may be varied to affect differential impedance. For example, the distance between the adjacent edges 24 of the first and second contacts 28, 30 may be varied, as may the distance between the centerlines of adjacent columns 33, 35. Adjacent columns 33, 35 refer to the columns of contacts 24 arranged edge to edge in FIG. 3. The distance between the adjacent edges of the first and second contacts may be referred to as the "gap width" shown as "g" in FIG. 3. Adjusting the gap width g may affect the distance between the adjacent edges 24 of the first and second contacts 28, 30. The distance between the centerlines of adjacent columns may be referred to as the "column pitch" shown as "p" in FIG. 3. Adjusting the column pitch may affect the distance between the adjacent broadsides 26 of the first and third contacts 28, 32.

The gap width g and column pitch p may be chosen such that the first and second electrical contacts 28, 30 provide the first pre-established differential impedance $Z_1$, while the first and third electrical contacts 28, 32 provide the second pre-established differential impedance $Z_2$. In other words, the connector may be designed to have a gap width g and column pitch p that cooperate to provide two pre-established differential impedances $Z_1$, $Z_2$ in a single connector. That is, the first and second electrical contacts 28, 30 may be separated by a first distance along the first direction, and the first and third electrical contacts 28, 32 may be separated by a second distance along the second direction, such that the first and second electrical contacts 28, 32 provide a first pre-established differential impedance $Z_1$ and the first and third contacts provide a second pre-established differential impedance $Z_2$. Thus, the contacts may be positioned relative to one another such that the first and second pre-established differential impedances $Z_1$, $Z_2$ provided are provided as a result of the arrangement.

It should be understood that a contact arrangement such as shown herein may include both edge-coupled and broadside-coupled differential signal pairs 29, 31. Thus, the same connector 12 may simultaneously provide both of two pre-established differential impedances $Z_1$, $Z_2$.

Figure 4:
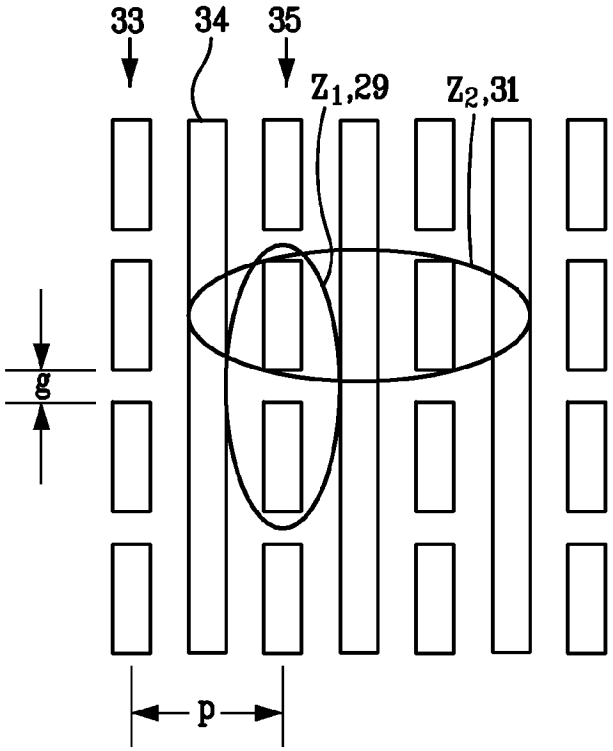
FIG. 4 depicts an example contact arrangement with dielectric walls disposed between columns of electrical contacts.

As shown in FIG. 4, a dielectric material 34, such as a plastic, for example, may be disposed between the broadsides of adjacent contacts. The dielectric material 34 may be a dielectric wall disposed between adjacent contact columns 33, 35.

Figure 5B:
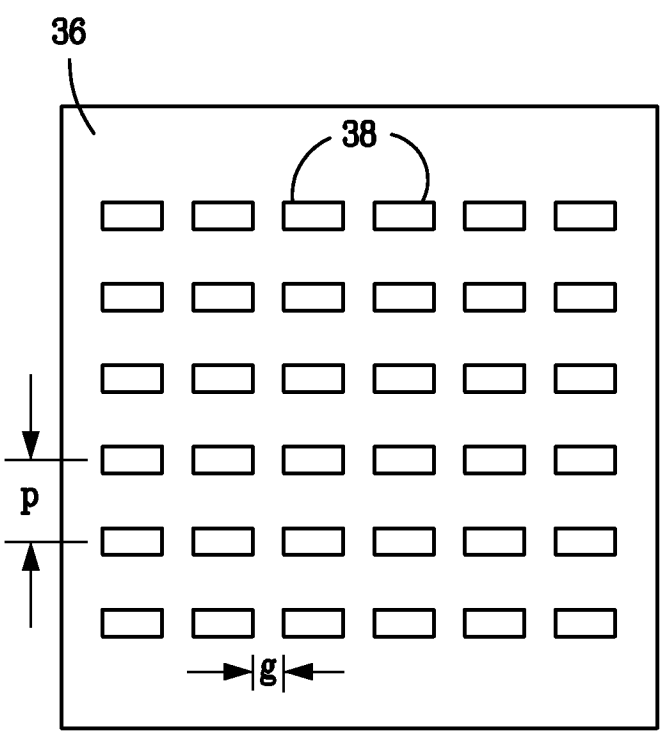
FIGS. 5A and 5B depict rotation of an example contact arrangement to affect differential impedance.
Figure 5A:
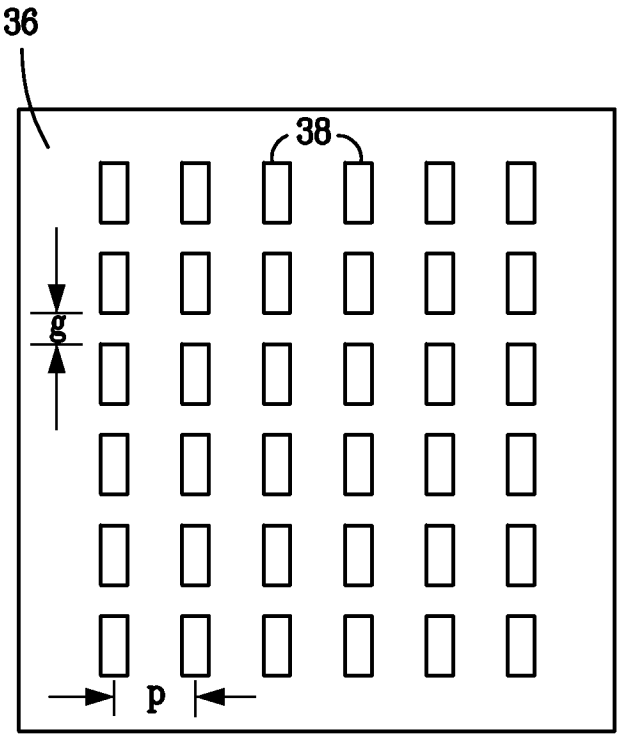

As shown in FIGS. 5A and 5B, such a connector 12 may be mounted onto a substrate 36. By way of example, the substrate 36 may be a printed circuit board and the connector 12 may be mounted in any of a plurality of orientations. Such a substrate 36 may have an arrangement electrically conductive elements 38, such as pads or through-holes. The electrically conductive elements 38 may be arranged in an arrangement corresponding to the connector footprint, such that, when the connector 12 is mounted onto the substrate 36, mounting ends of the contacts 22 may make electrical contact with the electrically conductive elements on the substrate.

The substrate 36 may be wired such that a certain two of the electrically conductive elements 38 form a differential signal pair. A connector 12 having a square grid footprint (of solder balls or compliant terminal ends, for example), may be set on the substrate 36 in a first orientation, as shown in FIG. 5A, or in a second orientation, as shown in FIG. 5B, that is rotated 90° relative to the first orientation. It should be understood that, when the connector 12 is mounted as shown in FIG. 5A, the connector 12 will provide the first differential impedance $Z_1$, and, when the connector 12 is mounted as shown in FIG. 5B, the connector 12 will provide the second differential impedance $Z_2$. Accordingly, the same connector 12 can provide a selected one of at least two different, pre-established differential impedances $Z_1$, $Z_2$, on the same substrate 36, depending on how it is oriented on the substrate. This is advantageous because a single part is capable of producing two distinct impedances.

As described above, an electrical connector 12 may be provided by pre-establishing two desired differential impedances $Z_1$, $Z_2$, and then designing the connector 12 such that an edge-coupled differential signal pair 29 provides the first of the two differential impedances $Z_1$, while a broadside-coupled differential signal pair 31 in the same connector 12 provides the second of the two differential impedances $Z_2$.

In an example embodiment, the contacts 22 may be arranged in a square grid, with a column pitch of 1.4 mm and row pitch of 1.4 mm. The contacts may be 0.35 mm thick (i.e., have 0.35 mm edges) and 1.0 mm wide (i.e., have 1.0 mm broadsides). Thus, the gap width between adjacent contacts in a column maybe 0.4 mm, and the distance between broadsides of adjacent contacts in a row may be 1.05 mm. A dielectric material having a thickness of 0.8 mm may be disposed between the columns, i.e., between the broadsides of adjacent contacts. Thus, the dielectric may be spaced 0.125 mm from the broadsides of the contacts.

In such a connector 12, where the contacts 22 along a column were arranged in a ground-signal-signal-ground arrangement, the differential impedance $Z_1$ of an edge-coupled differential signal pair 29 was found to be 82-83Ω. In the same connector 12, where the contacts 22 along a row were arranged in a ground-signal-signal-ground arrangement, the differential impedance $Z_2$ of a broadside-coupled differential signal pair 31 was found to be 98-99 Ω.

The invention claimed is:

1. An electrical connector, comprising:

a first electrical contact having an edge and a broadside;

a second electrical contact having an edge and a broadside; and a third electrical contact having an edge and a broadside, wherein the first and second electrical contacts are disposed adjacent each other and positioned edge-to-edge along a first direction, the first and third electrical contacts are disposed adjacent each other and positioned broadside-to-broadside along a second direction that is perpendicular to the first direction, the first and second electrical contacts provide a first pre-established differential impedance of 85 ohms±10 ohms when the first and second electrical contacts define a differential signal pair, and the first and third electrical contacts provide a second pre-established differential impedance of 100 ohms±10 ohms when the first and third electrical contacts define a differential signal pair.

2. The electrical connector of claim 1, further comprising a dielectric material between the first and third contacts.

3. The electrical connector of claim 1, wherein the first and second electrical contacts are separated by a first distance along the first direction, and the first and third electrical contacts are separated by a second distance along the second direction, such that the first and second electrical contacts provide the first pre-established differential impedance, and such that the first and third electrical contacts provide the second pre-established differential impedance.

4. The electrical connector of claim 3 wherein the first pre-established differential impedance is a function of the first distance and wherein the second pre-established differential impedance is a function of the second distance.

5. The electrical connector of claim 1, wherein first, second, and third electrical contacts are electrical signal contacts.

6. An electrical connector, comprising:

a connector housing;

first and second electrical contacts arranged edge-to-edge within the connector housing; and third and fourth electrical contacts arranged broadside-to-broadside within the connector housing, wherein the first and second electrical contacts provide a first pre-established differential impedance of 85 ohms±10 ohms when the first and second electrical contacts define a differential signal pair, and the third and fourth electrical contacts provide a second pre-established differential impedance of 100 ohms±10 ohms when the third and fourth electrical contacts define a differential signal pair.

7. An electrical connector system, comprising:

an electrical connector comprising a plurality of electrical contacts, each contact having a respective mounting end, the mounting ends defining a connector footprint; and a substrate having an arrangement of electrically conductive elements corresponding to the connector footprint both when the connector is mounted to the substrate in both a first orientation and a second orientation that is different from the first orientation, wherein the connector provides a first pre-established differential impedance when mounted on the substrate in the first orientation, and a second pre-established differential impedance when mounted on the substrate in the second orientation, the second differential impedance being different from the first differential impedance.

8. The electrical connector system of claim 7, wherein the first orientation is substantially perpendicular to the second orientation.

9. An electrical connector, comprising:

a first electrical contact;

a second electrical contact positioned adjacent to the first electrical contact along a first direction; and a third electrical contact positioned adjacent to the first electrical contact along a second direction that is perpendicular to the first direction, wherein the first electrical contact and the second electrical contact provide a differential impedance of 85 ohms±10 ohms, the first electrical contact and the third electrical contact provide a differential impedance of 100 ohms±10 ohms.

10. The electrical connector of claim 9, wherein the contacts are positioned relative to one another so as to achieve the differential impedance of 85 ohms±10 ohms.

11. The electrical connector of claim 10, wherein the contacts are positioned relative to one another so as to achieve the differential impedance of 100 ohms±10 ohms.

12. The electrical connector of claim 9, wherein the first and second electrical contacts are separated by a first distance along the first direction, and the first and third electrical contacts are separated by a second distance along the second direction, such that the first and second electrical contacts provide the differential impedance of 85 ohms±10 ohms, and the first and third electrical contacts provide the differential impedance of 100 ohms±10 ohms.

13. The electrical connector of claim 9, wherein each of the first, second, and third electrical contacts has a respective broadside and a respective edge, the first and second signal contacts are positioned edge-to-edge, and the first and third signal contacts are positioned broadside-to-broadside.

14. The electrical connector of claim 13, further comprising a dielectric material between the first and third contacts.

15. A method for designing an electrical connector, the method comprising:

identifying a first differential impedance of 85 ohms±10 ohms;

identifying a second differential impedance of 100 ohms±10 ohms; and designing an electrical connector including a connector housing, and a first signal contact, a second signal contact, and a third signal contact all supported by the connector housing, such that the second signal contact is positioned adjacent to the first signal contact along a first direction, and the third signal contact positioned adjacent to the first signal contact along a second direction that is perpendicular to the first direction, wherein the first signal contact and the second signal contact provide the first differential impedance, and the first signal contact and the third signal contact provide the second differential impedance.

16. The method of claim 15, wherein each of the signal contacts has a respective broadside and a respective edge, the first and second signal contacts are positioned edge-to-edge, and the first and third signal contacts are positioned broadside-to-broadside.

17. The method of claim 16, wherein the connector further comprises a dielectric material between the first and third contacts.

18. The method of claim 16, wherein the first and second signal contacts are disposed in a first leadframe housing.

19. The method of claim 18, wherein the third signal contact is disposed in a second leadframe housing that is adjacent to the first leadframe housing.

20. The method of claim 15, wherein the first and second signal contacts are separated by a first distance along the first direction, and the first and third signal contacts are separated by a second distance along the second direction, the method further comprising: determining the first and second distances such that the first and second signal contacts provide the first differential impedance and the first and third signal contacts provide the second differential impedance.

* * * * *